US006386914B1

(12) United States Patent
Collins et al.

(10) Patent No.: US 6,386,914 B1
(45) Date of Patent: May 14, 2002

(54) ELECTRICAL CONNECTOR HAVING MIXED GROUNDED AND NON-GROUNDED CONTACTS

(75) Inventors: Gordon T. Collins, Sidney; David L. Frear, Bainbridge, both of NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/816,241

(22) Filed: Mar. 26, 2001

(51) Int. Cl.[7] ..... H01R 9/05
(52) U.S. Cl. ..... 439/579; 439/98
(58) Field of Search ..... 439/579, 578, 439/580, 584, 585, 607, 92, 95, 96, 98, 108

(56) References Cited

U.S. PATENT DOCUMENTS 3,078,436 A 2/1963 Berry ..... 439/579
3,825,874 A * 7/1974 Peverill ..... 439/579
3,852,700 A * 12/1974 Haws ..... 439/98
4,340,265 A * 7/1982 Ott et al. ..... 439/578
4,519,666 A * 5/1985 Williams et al. ..... 439/578
4,531,790 A * 7/1985 Selvin ..... 439/92
4,572,600 A * 2/1986 Nieman ..... 439/92
4,708,666 A * 11/1987 Fisher, Jr. ..... 439/580
4,830,628 A * 5/1989 Dyson et al. ..... 439/584
4,974,075 A 11/1990 Nakajima ..... 439/579
5,169,323 A * 12/1992 Kawai et al. ..... 439/95
6,137,056 A * 10/2000 Miyazaki ..... 174/78

* cited by examiner

*Primary Examiner*—Tulsidas Patel
(74) *Attorney, Agent, or Firm*—Blank Rome LLP

(57) ABSTRACT

An electrical connector has both grounded cables, such a coaxial or triaxial cables, and ungrounded cables or lines. A metallic outer connector body (200) has bores (270) for the grounded cables, which are held in place in the connector body with retainer clips (400). The retainer clips snap into place in spaces (244) inside the outer connector body and the contacts snap into the retainer clips. The center of the outer connector body accepts an inner connector body 100, which is dielectric.

18 Claims, 4 Drawing Sheets

ELECTRICAL CONNECTOR HAVING MIXED GROUNDED AND NON-GROUNDED CONTACTS

BACKGROUND OF THE INVENTION

1. Field of the Invention

The present invention relates to combined connectors, having mixed grounded and non-grounded contacts and to connectors with shielding.

2. Description of the Prior Art

Nakajima, in U.S. Pat. No. 4,974,075, discloses a connector with a coaxial arrangement of contact pins (62*b*) and mating sockets (81*a*) which engage the pins when the two parts of the connector are joined by relative motion in the axial direction. The pins are laid out in two concentric circles, one inside the other, to form two radial groups of contacts. The contacts are of the insulated type, with their conductors surrounded by plastic.

Nakajima provides shielding with a tubular or annular-cylindrical metal shield around the entire connector and another shield in between the inner and outer groups of contacts; the various parts fit together like telescope tubes, with alternating metal and plastic. Thus, electrical contacts belonging to the inner and outer circles are shielded from one another, but there is no shielding between contacts both belonging to one of the two radial groups of concentric contacts, which are separated only by plastic. There is nothing to prevent cross-talk within a radial group of contacts.

Another drawback of Nakajima's arrangement is mechanical weakness. The cylindrical annular plastic portions, in which the pins and sockets are embedded, have walls of minimum thickness because the interfitted metallic shields create extra bulk. The metal shielding pieces are relatively thin, too, for the same reason. If the assembled connector is subjected to a bending stress the interfitted annular cylindrical portions of the connector are liable to warp, making it difficult to separate and rejoin the two halves of the connector.

Each of Nakajima's mating connector halves uses expensive constructions, such as large-diameter threads and shoulder stops. Such large threads are not only expensive, but difficult to join.

The Nakajima arrangement is unsuited to connectors including ground contacts. For example, it would be difficult or impossible to adapt to a plurality of coaxial cable conductor pairs, or to shielded conductor pairs.

SUMMARY OF THE INVENTION

One object of the present invention is a connector that combines grounded lines in a single connector, for example, combining a coaxial cable with grounded outer conductor with a plurality of shielded conductor pairs.

Another object is a connector which is mechanically strong and tough.

Still another object is a connector which can simultaneously join triaxial, twinaxial, and/or coaxial cables and join their grounds at the same time.

The present invention provides a conductive, preferably solid metallic, insert or connector body for connecting a plurality of grounded cables, these being in addition to the usual non-grounded lines or cables typically found in the middle of a military-style (or other) connector. The insert comprises two mating annular cylinders each of which preferably fits into one half of a standard connector housing. Bores run longitudinally through the assembled connector body from end to end, and meet at the junction between the two cylinders. The cable couplings are held in each of the two cylinders with retention clips, so that the couplings mate when the two cylinders are mated.

Because the insert is conductive it provides an ideal common ground to which each of the grounded cable grounds can be coupled, and it also provides a Faraday shield around the coupling of each cable, to limit cross-talk. A common electrical connection exists among the two cylinders and the grounds of the cables. If the connector housings are metallic, a second electrical connection between each of the cylinders and its respective housing is preferably made as well. Staking is the preferred method of making this connection.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 1:
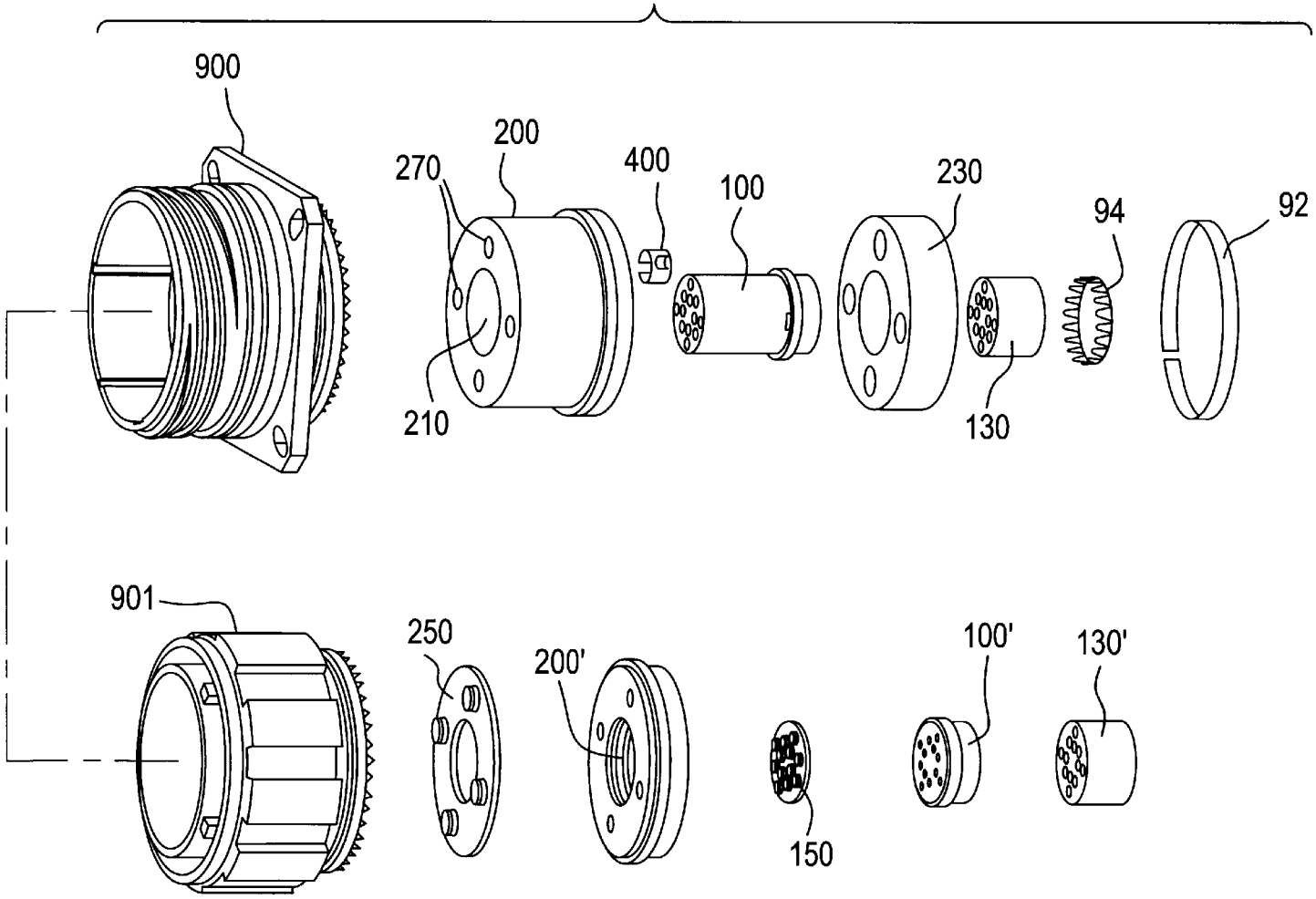
FIG. 1 is an exploded perspective view of an electrical connector in accordance with the invention.

FIG. 1 shows the electrical connector of the invention in overview, with two mating connectors being pictured. The parts above will be discussed first. A shell 900 is preferably conventional (the military style is shown in the drawing). The mating shell 901 is shown below. Such shells conventionally contain a single connector assembly each, with many pins or sockets in a dielectric to keep them insulated from one another. That is modified in the present invention.

Fitting inside the shell 900 are not one but two preferably nesting parts, an inner connector body 100 of dielectric and a outer connector body 200. The outer connector body 200 has an axial aperture 210 for accepting the inner connector body 100.

Preferably, the inner connector body 100 is standard, like the shell 900, but is of a smaller size than the standard size that would fit the shell 900. The outer connector body 200 is then dimensioned to accept the inner dielectric connector body 100 and to be accepted by the shell 900.

The outer connector body 200 is conductive, preferably constructed of a metallic material such as plated aluminum. Alternatively, it may be made with non-a conductive material, such as plastic, impregnated with conductive particles or fibers to be conductive, or coated with a conductive material. The outer connector body 200 preferably functions as both a ground and as a Faraday shield, and any construction that is consistent with either of these two functions is within the scope of the present invention.

Figure 3:
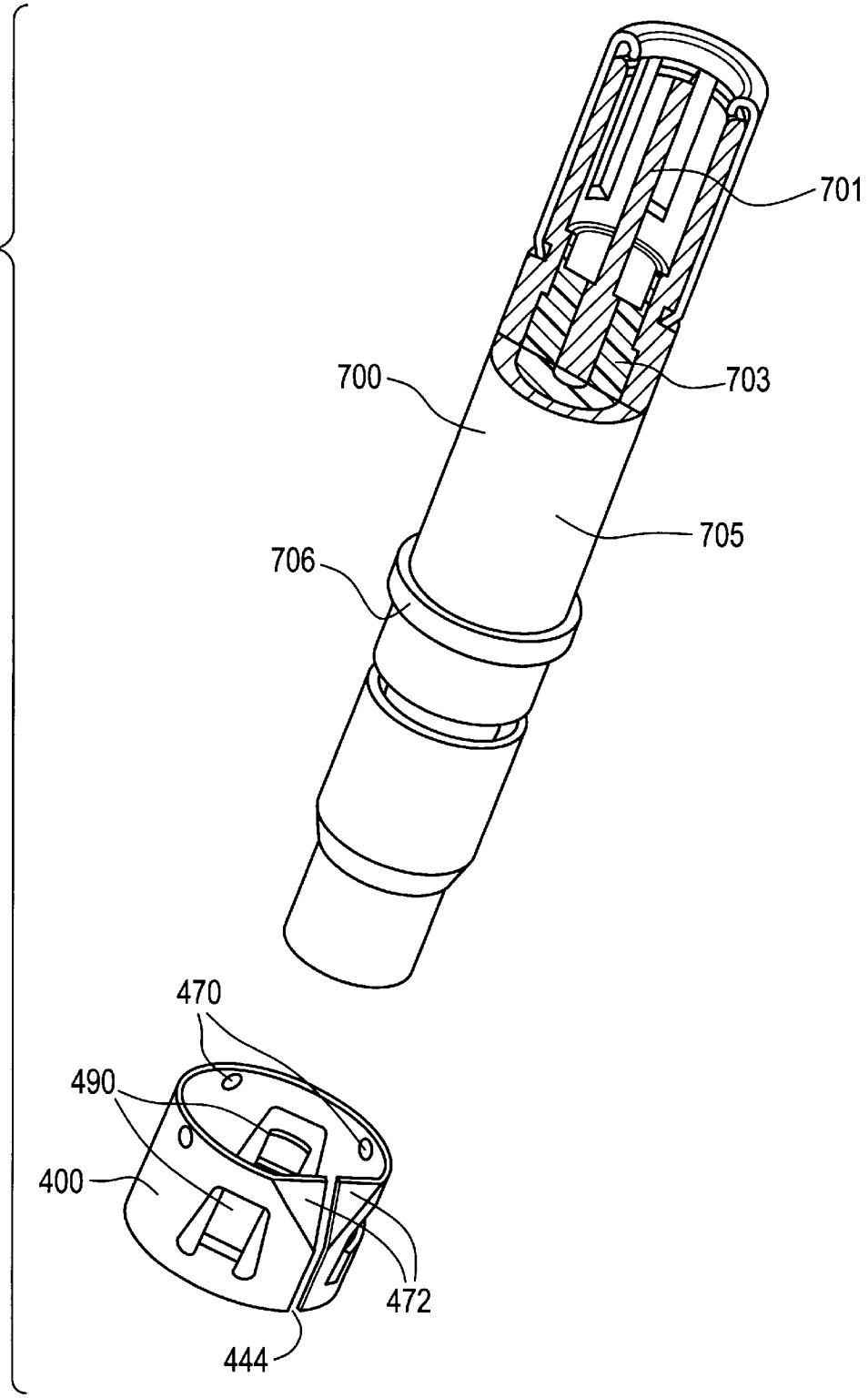
FIG. 3 is an exploded perspective, detail, and partially cut-away view of coaxial contact cylindrical retainer clip.

Positioned about the annulus of the outer insert or connector body 200 is a plurality of apertures 270 for accepting and retaining coaxial or triaxial contacts. Each of the plurality of apertures 270 is adapted to accept internally a grounding retainer clip 400, which is shown in more detail in FIG. 3. The retainer clip 400 holds within each aperture 270 a grounded (e.g., coaxial or triaxial) contact 700, that is also shown in FIG. 3. the outer surface of the contact 700 is a ground for that grounded cable.

Figure 2:
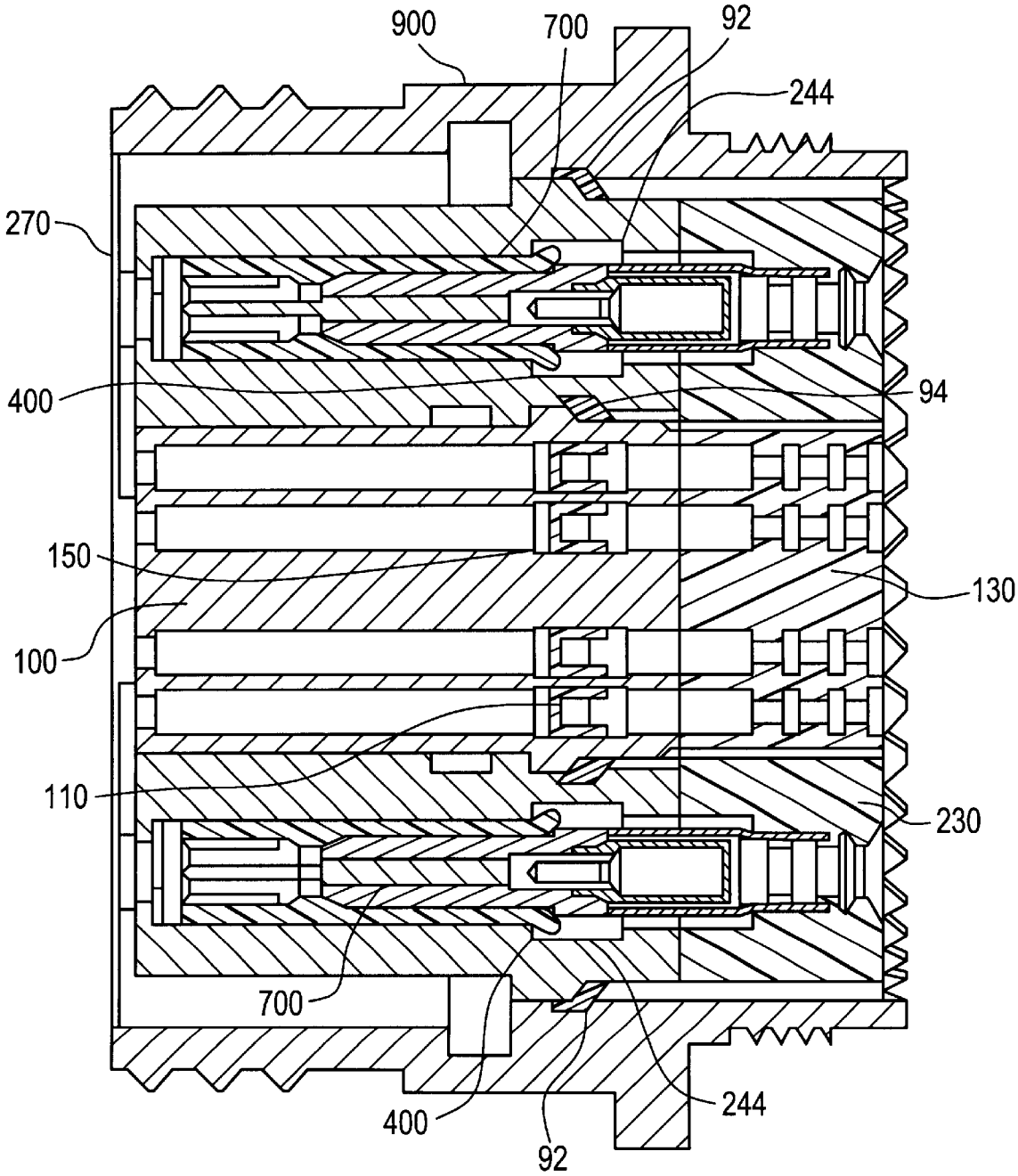
FIG. 2 is a cross-sectional view of the assembled connector of FIG. 1.

FIG. 2, a cross-sectional view on a plane lying on the axis of the assembled connector of FIG. 1, shows how the upper parts depicted in FIG. 1 fit together into the shell 900, and also shows the shape of portions of the outer connector body 200 that are hidden in FIG. 1. Since the connector body 200 as a whole, and the bores of the apertures 270, are figures of revolution in the illustrated embodiment, the outline in FIG. 2 specifies the shape completely for the illustrated preferred embodiment.

The inner connector body 100 has contacts 110 fitted in the through-holes, preferably held in place by retainer clips 150. The inner connector body 100 is conventional in the preferred embodiment and will not be discussed further.

An inner resilient elastomer moisture sealing grommet 130 is placed behind the inner connector body 100, and an annular, outer resilient elastomer moisture sealing grommet 230 is placed behind the outer connector body 200.

The parts that fit together into mating shell 901, shown at the bottom of FIG. 1, hold the contacts (plain, coaxial, triaxial, etc.) that mate with the contacts of the upper shell 900; that is male and female connector parts are reversed. The two shells are depicted facing the same direction; one would need to be reversed before they could be mated.

The parts of shell 901 that correspond to parts of shell 900 are indicated by primes. For example, outer connector body 200' is generally similar to outer connector body 200, but much shorter, and it does not accept any of the contacts 700 that are shown in FIG. 3 and are discussed below. However, it will accept the retainer clips 400. The connector bodies 200 and 200' form a pair of conductive, mating, annular cylinders each including a central space and an outer surface.

Additional parts that go into shell 901, that lack corresponding parts in shell 900, include two elastomer face seals 250 and 150 for sealing pin inserts or other contacts or parts, through which the contacts protrude in the alternate arrangement through raised tower portions.

It is noted that in the preferred embodiment the shells 900 and 901 is each capable of accepting the parts for the other shell.

FIG. 2 shows, located between the rear ends of the inner connector body 100 and the outer connector body 200, a compressible ring 94, which may be conventional. It is fitted between the inner connector body 100 and a shoulder in the bore of the outer connector body 200, which takes the place of a shoulder in a shell of a standard size smaller than the shell 900 shown in the drawing, in interacting with the ring 94. (The smaller shell is not shown.) The illustrated shell 900 includes a corresponding shoulder that, with a conventional connector insert, would press against the dielectric body.

In the present invention, the shoulder of the shell 900 instead bears against a staking ring 92 that is preferably compressible and of plated metal. It acts as an electrical bridge between the shell 900 and the outer connector body 200 to effectively ground the conductive outer connector body 200, which in turn provides a ground for the grounded contacts 700 inside it. The contacts 700, inside the grounded, conductive outer connector body 200, are both effectively grounded and electromagnetically shielded.

FIG. 3 shows an exemplary coaxial contact 700 and the generally cylindrical retainer clip 400 of the present invention, which holds the contact 700 within the bore of the aperture 270 of the outer connector body 200. The coaxial contact 700 is shown partly cut away to disclose the coaxial inner structure of center conductor 701, dielectric insulation 703, and outer conductor casing 705 (the grounded portion). The casing 705 comprises an annular flange 706. The rounded tip of the center conductor 701, at the top of FIG. 3, is adjacent to the aperture 270 in the assembled connector (see FIG. 2).

The retainer clip 400 is preferably a conductive grounding clip, making electrical contact between the outside of the contact 700 and the inside of the aperture 270 in the preferably metallic outer connector body 200, and it is preferably made of an elastic metal, such as beryllium copper, or it may be plated. Such a retainer clip 400 creates a circuit from the casing 705 of the contact outer body 700 to the outer connector body 200. It also holds the contact 700 in position with the outer connector body 200.

The retainer clip 400 preferably includes two inwardly protruding clip edges 472 of the retainer clip 400, which bear against the surface of flange 706 to augment and insure the grounding connection between the retainer clip 400 and the contact 700. The retainer clips 400 are inserted into the end of the outer connector body 200 that is on the right in FIG. 2. The retainer clip 400 has a plurality of inwardly protruding dimples 470 and also several inwardly protruding resilient tines 490.

Figure 5:
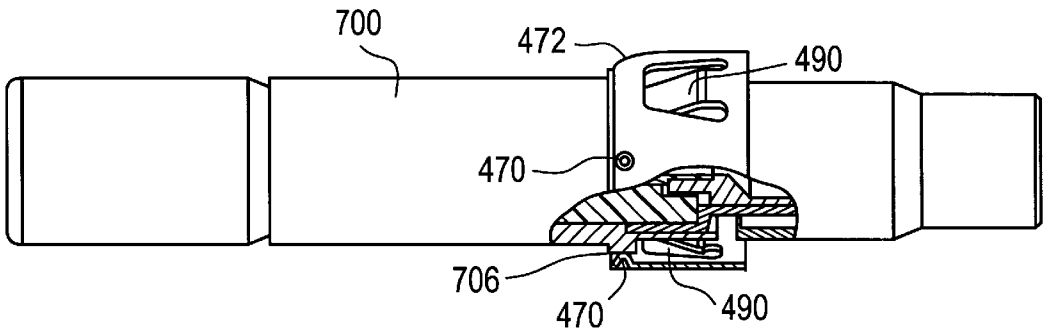
FIG. 5 is a combination side view and sectional view, with the sectional portion taken on a center line of the contact.
Figure 4:
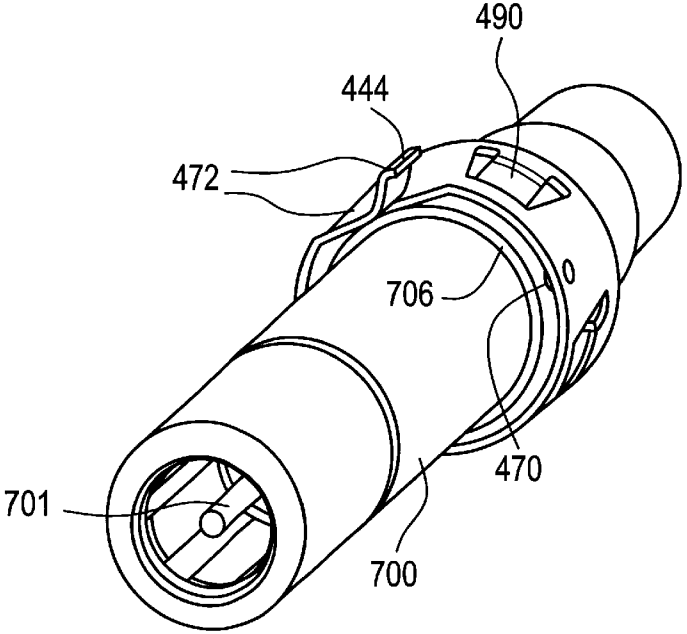
FIG. 4 is a perspective view.

FIGS. 4 and 5 show the retainer clip 400 assembled to the contact 700 in the same relative position which they have when the two are retained inside the outer connector body 200. The ends of the tines 490 abut one side of the flange 706, which prevents the flange from moving in the opposing direction relative to the retaining clip 400. The dimples 470 and clip edges 472 rest on the outer cylindrical surface of the flange 706. The dimples center the contact 700 to maintain the force of the clip edges 472, which are intended to act primarily as a grounding contact.

Figure 6:
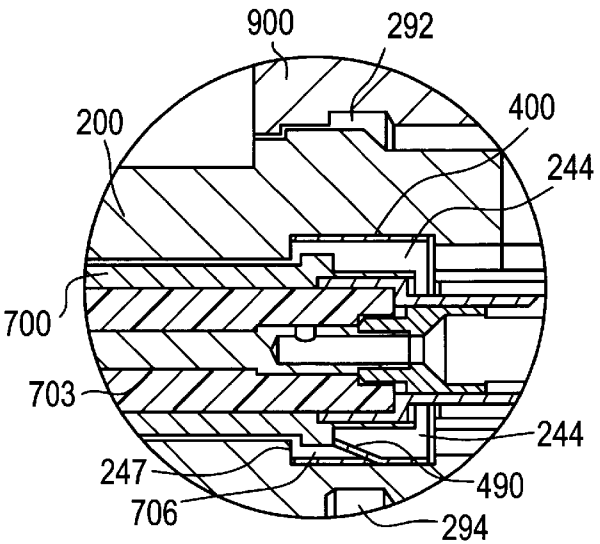
FIG. 6 is a detail view of FIG. 2. It is similar to the sectional portion of FIG. 5 except that the retainer clip is at a different angle about the contact longitudinal axis.

FIG. 6 shows in greater detail how contact 700 and retainer clip 400 are held in the connector body 200. At the lower side this figure shows how the end of the tine 490 abuts the other side of the flange 706. The forward shoulder 247 of an annular space 244 is seen to abut the flange 706 and therefore it acts as a stop for the contact 700 as well as for the retainer clip 400. FIG. 6 also shows a space 292 into which the staking ring 92 is compressed. The staking ring 92 is not shown in FIG. 6, however. A space 294 which holds the ring 94 is likewise visible.

Because the flange is held by the forward interior shoulder or stop 247 on one side and by the ends of the tines 490 on the other side, the flange is held in the axial direction and the contact 700 cannot fall out.

Assembly is as follows:

The retainer clip 400 includes a longitudinal gap 444, by which it is radially compressible. While compressed, its diameter is small enough that it can slide into the annular space 244 inside the outer connector body 200. This annular space 244 is cylindrical, slightly longer than the retainer clip 400, and has abrupt inward steps or shoulders at either end;

and it has a diameter slightly smaller than that of the retainer clip 400 in its relaxed state (i.e., when the gap 444 is open). Therefore, the retainer clip 400 can be radially compressed and inserted into the annular space 244, where it snaps outward by its own resilience and becomes locked in place inside the annular space 244, against the inward stops or shoulders at either end. The end of the clip with the dimples 470 is inserted foremost into the annular space 244 in the outer connector body 200.

The ends of the tines 490 project into the cylindrical space inside the main body of the retainer clip 400. With the retainer clip inserted, the flange 706 of the contact 700 is able to slide through the retainer clip 400 (in the upward direction in FIG. 3, to the left in FIG. 6) by forcing the resilient tines 490 outward toward the inner wall of the annular space 244. The tines 490 then snap inward after passing over the shoulder of the flange 706.

Here, and in the following claims, "annular cylinder" or "cylindrical annulus" means an object or portion of an object which extends generally prismatically (i.e., with a more-or-less constant cross section) along an axis or center line and which has, in cross section, a central opening and a surrounding outer perimeter. The central opening and the outer perimeter may optionally be circular and may optionally define between them a generally constant width. While "cylindrical" usually implies a circular cross section, it does not necessarily do so herein.

Although the preferred form of the outer insert is illustrated to be shaped as an annulus of a cylinder (with a cylindrical bore opening and cylindrical outside perimeter), the inserted connector body of the present invention may have a variety of outside and inside shapes, such as polygonal, elliptical, and so on, and the inside and outside shapes need not be similar. Also, the outer connector body need not surround the inner connector body, but instead may be, for example, C-shaped.

The word "insert" can mean an inserted part of some combination or it can refer to a stand-alone element by itself, whether or not inserted into anything.

The word "cable" can refer to a cable itself and/or its termination, e.g., contacts in a connector.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. An electrical connector, for connecting a first plurality of grounded cables and a second plurality of ungrounded cables, the connector comprising:

for connecting the grounded cables, a conductive outer connector body including a central space and a plurality of bores holding respective ones of the grounded cables;

for connecting the ungrounded cables, a non-conductive inner connector body disposed within the central space; and an electrical connection between a grounded contact of each of the grounded cables and the outer conductive body.

2. The connector according to claim 1, wherein the outer connector body comprises an annular cylinder and the central space passes therethrough from end to end.

3. The connector according to claim 1, wherein the outer body is held within a shell.

4. The connector according to claim 3, comprising a conductive staking ring making electrical contact between the shell and the outer connector body.

5. The connector according to claim 1, wherein the electrical connection comprises a metallic retainer clip making electrical contact between the grounded contact and the outer connector body.

6. The connector according to claim 5, wherein the retainer clip comprises a locking structure to hold the cable in one of the cable-accepting bores.

7. The connector according to claim 6, wherein the retainer clip is annular and is disposable in a cylindrical space inside one of the cable-accepting bores.

8. The connector according to claim 7, wherein and the locking structure comprises a resilient tine that projects into the cylindrical space and wherein the resilient tine snaps behind an annular shoulder of the grounded contact.

9. The connector according to claim 8, wherein the grounded contact comprises a flange and the flange comprises the annular shoulder.

10. The connector according to claim 8, wherein the outer connector body comprises a stop preventing the retainer clip from moving past a position wherein the resilient tine snaps behind the annular shoulder of the grounded contact.

11. The connector according to claim 10, wherein an interior shoulder of the cylindrical space comprises the stop.

12. The connector according to claim 8, wherein the outer connector body comprises a stop preventing the grounded contact from moving past a position wherein the resilient tine snaps behind the annular shoulder of the grounded contact.

13. The connector according to claim 12, wherein an interior shoulder of the cylindrical space comprises the stop.

14. The connector according to claim 8, wherein the retainer clip comprises a centering structure.

15. The connector according to claim 14, wherein the centering structure comprises a plurality of dimples.

16. The connector according to claim 7, wherein the retainer clip is resilient and snaps into the cylindrical space inside the one of the cable-accepting bores.

17. The connector according to claim 5, wherein the metallic retainer clip comprises protruding clip edges in contact with at least one of the outer connector body and the grounded cable.

18. In combination:

a male connector housing having a first size, a conductive connector insert having a second size, and a non-conductive connector insert having a third size smaller than the second size and being assembled inside the conductive connector insert;

the connector inserts being fitted inside the male connector housing and including a plurality of cable-accepting bores passing through the connector inserts from end to end; and a female connector housing having a fourth size and being fitted onto the male connector housing.

* * * * *